United States Patent [19]

Newgaard, II

[11] 3,963,167

[45] June 15, 1976

[54] PACKAGING FILLER DIVIDER

[75] Inventor: Larry J. Newgaard, II, Lenexa, Kans.

[73] Assignee: Hallmark Cards, Incorporated, Kansas City, Mo.

[22] Filed: Jan. 23, 1975

[21] Appl. No.: 543,441

[52] U.S. Cl. ..... 229/14 C; 206/425; 229/27

[51] Int. Cl.[2] ..... B65D 5/56

[58] Field of Search ..... 229/42, 14 C, 27, 37 R, 229/39 B; 206/521, 494, 425

[56] References Cited

UNITED STATES PATENTS

| | | | |
|---|---|---|---|
| 1,737,950 | 12/1929 | Scotland | 229/27 |
| 1,850,329 | 3/1932 | Metzger | 229/37 R |
| 2,609,136 | 9/1952 | Sider | 206/521 X |
| 2,940,653 | 6/1960 | Miessler | 229/39 B |
| 3,043,488 | 7/1962 | Warwick | 206/521 X |
| 3,232,513 | 2/1966 | Maio | 206/521 X |
| 3,708,101 | 1/1973 | McDanield | 206/521 X |

*Primary Examiner*—Stephen P. Garbe
*Attorney, Agent, or Firm*—Schmidt, Johnson, Hovey & Williams

[57] ABSTRACT

An easily fabricated, yet extremely sturdy packaging filler divider for merchandise display of cartons or the like is provided which includes an elongated, tubular body with a central reinforcing sheet therein having marginal flaps extending oppositely from the sheet and connected to opposed internal sidewall portions of the body; by virtue of this construction fabrication costs are drastically reduced since the filler can be produced from a single, continuous sheet of paper stock using completely automated equipment with only two simple folds being required, and moreover the resistance to crushing or other deformation of the filler is greatly enhanced. In preferred forms, the filler is fabricated from an initially flat, precut paper blank such that the finished divider can be folded to a flat storage position when not in use.

5 Claims, 9 Drawing Figures

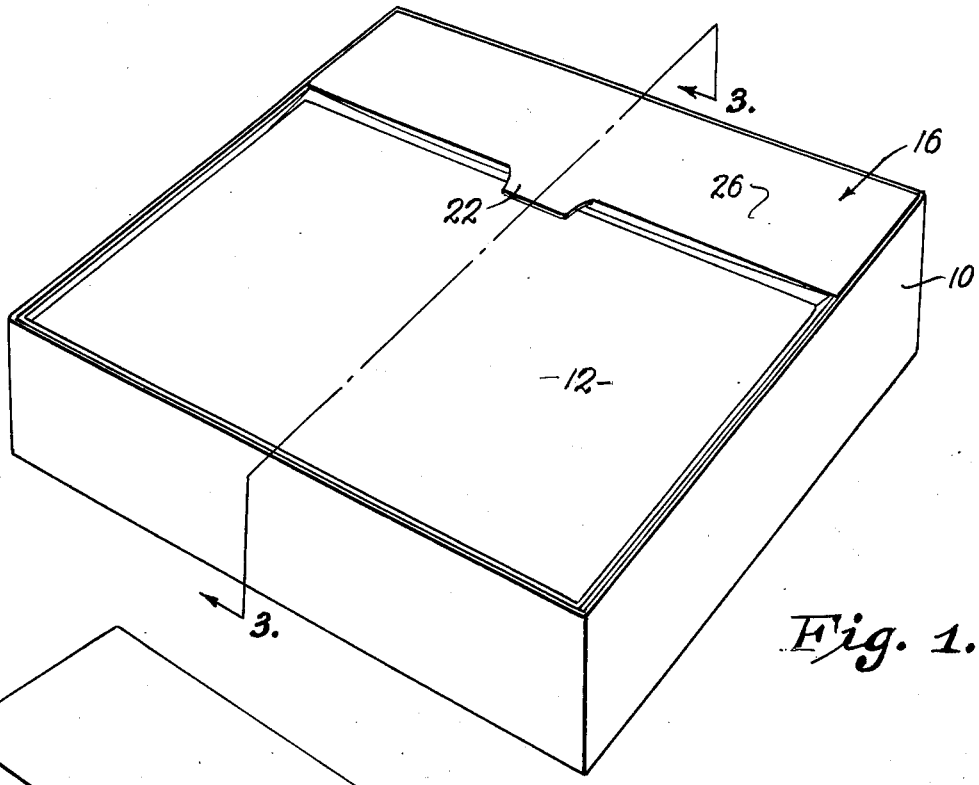
Fig. 1.
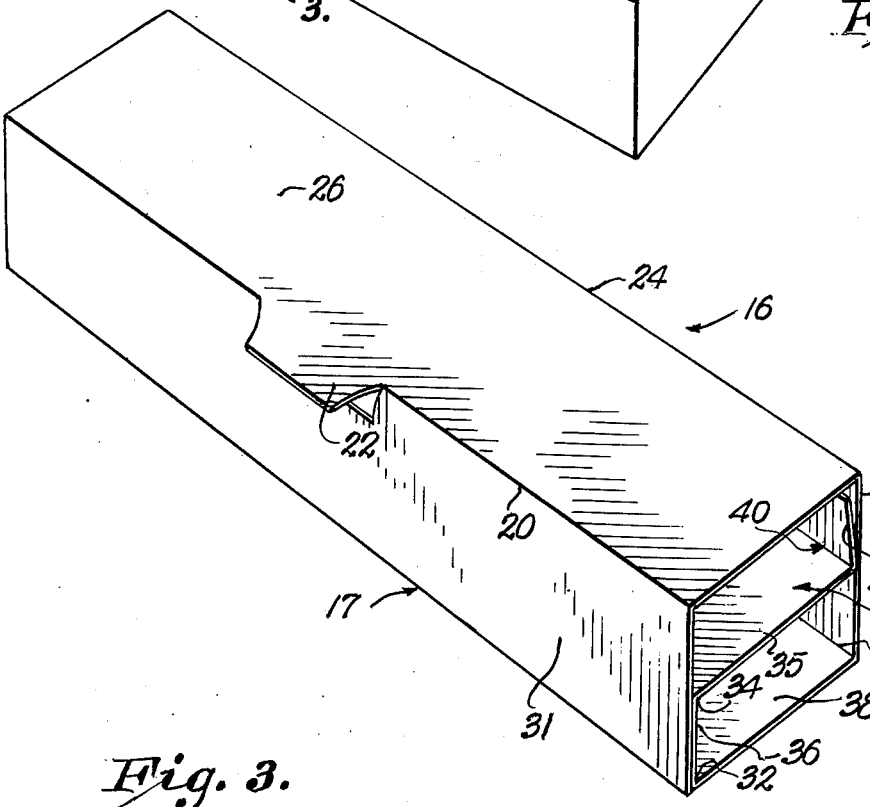
Fig. 2.
Fig. 3.
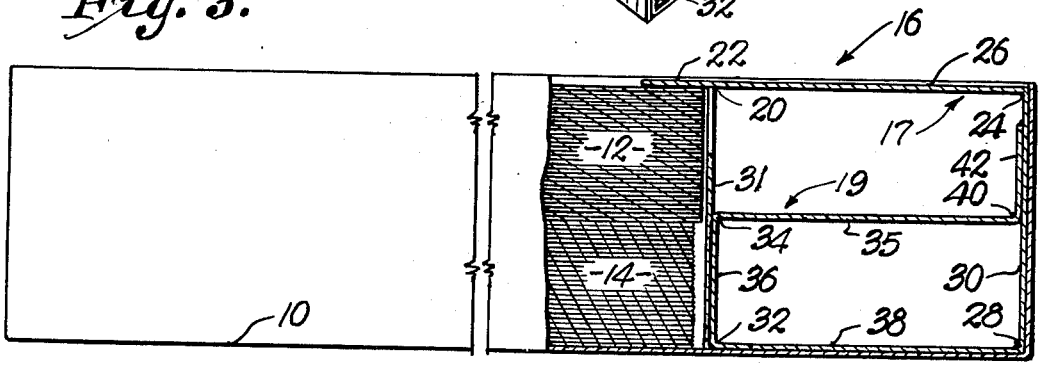

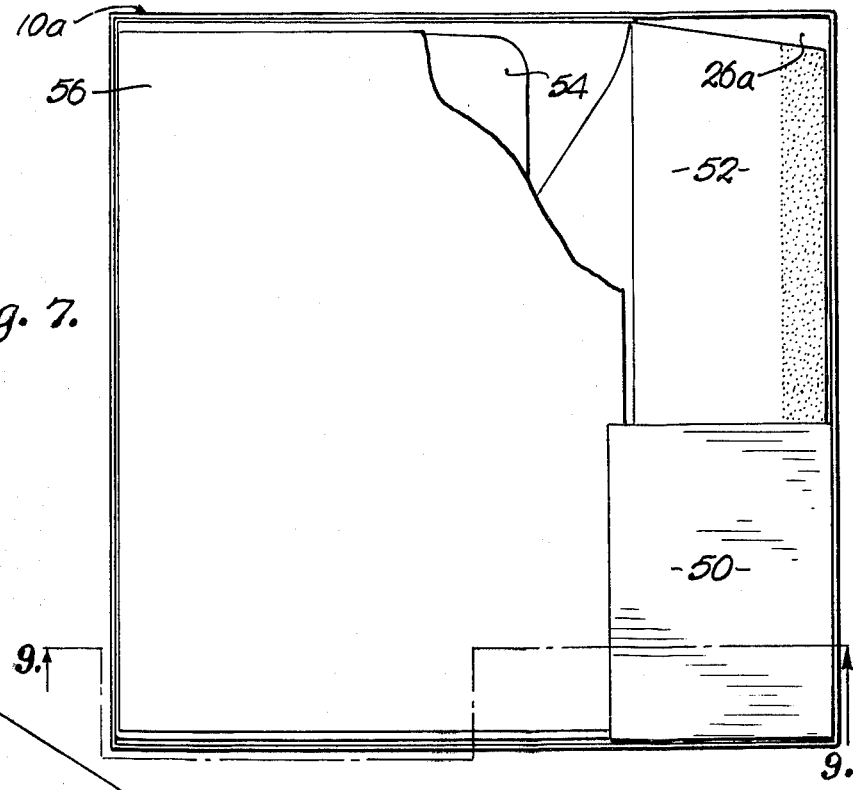
Fig. 7.
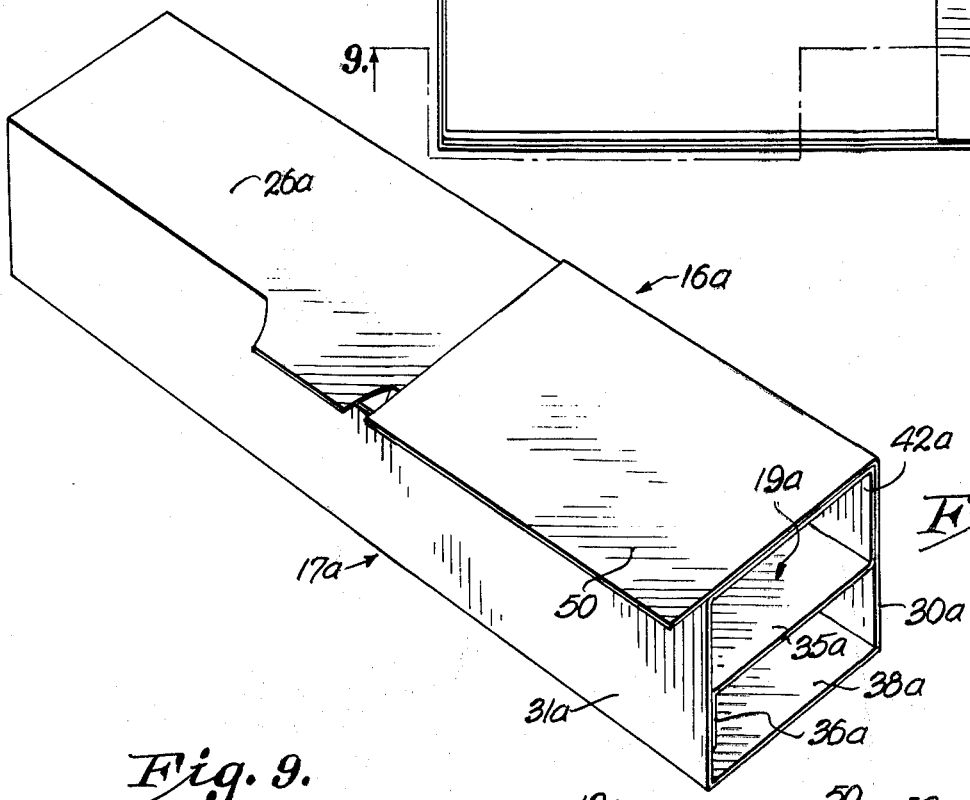
Fig. 8.
Fig. 9.
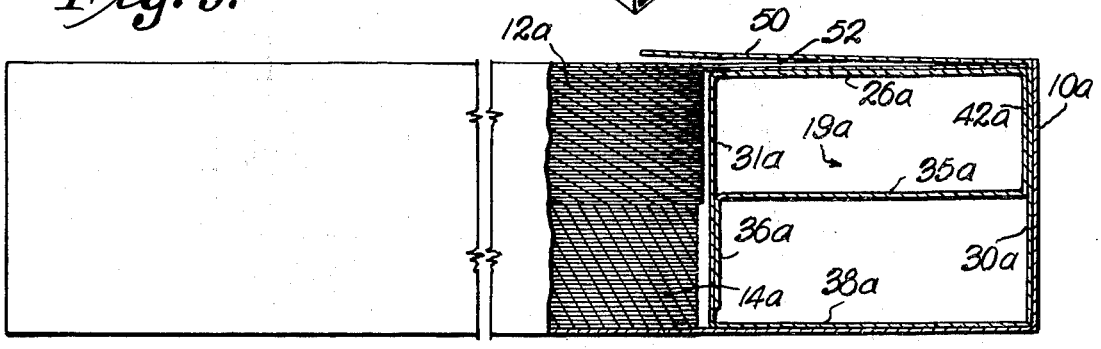

PACKAGING FILLER DIVIDER

This invention relates to packaging filler dividers for use with a variety of merchandise display cartons such as greeting card boxes in order to permit utilization of standard size cartons with various sizes and types of merchandise. More particularly, it is concerned with such fillers which exhibit increased resistance to crushing or other deformations while also being extremely simple and inexpensive to produce without the need for manual labor of any sort.

In recent years there has been a tremendous increase in the costs associated with the merchandizing of all types of gift items and the like. For example, in the greeting card industry, even simple card boxes have risen drastically in cost, thus prompting many manufacturers to seek a more economical method of packaging. One attempt at reducing these costs has involved use of standard size boxes which can be utilized in the packaging of various sizes of greeting cards, since it is generally cheaper for a manufacturer to order and stock only a few standard size card boxes as opposed to many varieties thereof. Of course, with the use of standard size car boxes, packaging fillers must be provided for ensuring that small cards do not shift or move about in a relatively large standard box since such shifting could damage the cards and create an untidy display appearance.

The need for packaging fillers of differing sizes has necessarily lead many manufacturers to investigate various types of such units and methods of production thereof. One type of common filler consists simply of an elongated, tubular body of paper stock or the like which is configured for reception within a standard size card box to fill the open volume therein when small cards are to be packaged. However, in the use of these types of packaging fillers a number of problems have arisen. First of all, in order to be economically feasible, the cost of the fillers must be relatively small and therefore any production advantage leading to lower overall costs is an important factor. In particular, many prior fillers have been unduly expensive by virtue of the fact that hand labor is required in the fabrication thereof; for example, manual folding and gluing together of such units is not uncommon.

Just as important however, the fillers heretofore in use have not been sufficiently sturdy to withstand shocks or the like and protect the sale merchandise within the standard display cartons. This has led to the return by retailers of many boxes of merchandise to the manufacturers which of course necessitates discarding the entire contents of the carton and otentimes the filler and carton itself.

It is therefore the most important object of the present invention to provide a packaging filler for use with merchandise cartons which has sufficient strength to withstand normal shocks and rough handling encountered during shipping and merchandizing the fact that the filler can be simply produced using automated equipment without any necessity whatsoever of hand labor.

Another aim of the invention is to provide such a packaging filler having an elongated, generally tubular body with a central reinforcing sheet therein, the sheet having side marginal flaps attached to the opposed inner sidewalls of the body and extending in opposite directions from the sheet in order to enhance the strength characteristics of the filler and facilitate fabrication thereof.

A still further object of the invention is to provide a packaging filler which can be produced from a single precut sheet of paper stock material or the like utilizing only two simple folds and corresponding glue lines in order to greatly facilitate mechanical production of the fillers at dramatically reduced costs.

In the drawings:

FIG. 1 is a perspective view in a greeting card display carton having the packaging filler of the present invention received therein along with a stack of greeting cards and envelopes;

FIG. 2 is a perspective view of the packaging filler illustrated in FIG. 1;

FIG. 3 is a view in partial vertical section taken along line 3—3 of FIG. 1;

FIG. 7 is a partially broken away, top plane view of another embodiment of the present invention, shown operatively positioned within a cord box;

FIG. 8 is a perspective view of the filler divider illustrated in FIG. 7; and FIG. 9 is a view in partial vertical section taken along line 9—9 of FIG. 7.

Figure 4:
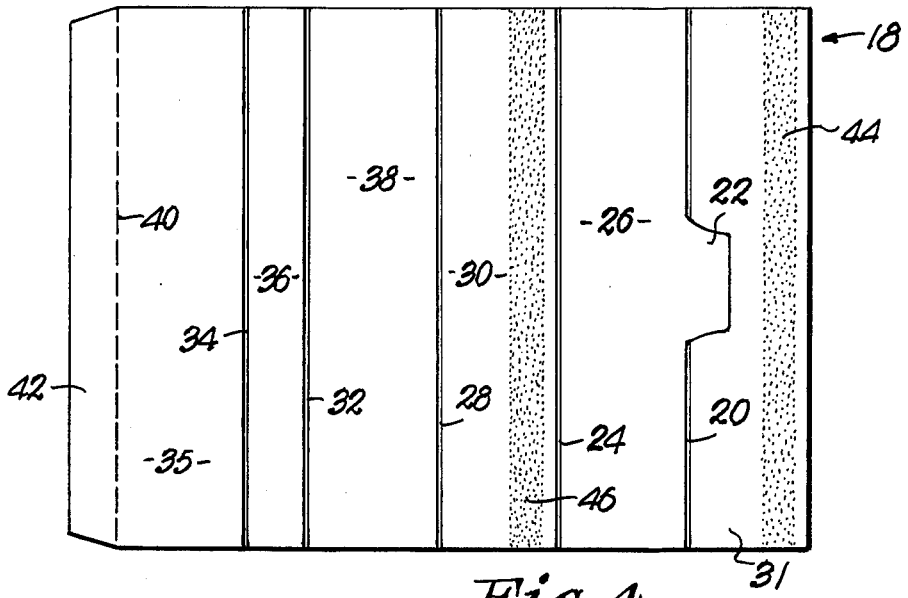
FIG. 4 is a side elevational view of a precut and scored filler blank prior to production of the packaging filler illustrated in FIG. 2.

Referring now to the drawings, there is shown a packed greeting card carton 10 having a stack of greeting cards 12 and envelopes 14 therein (see FIGS. 1 and 3). The cards 1a and envelopes 14 are of lesser width than that of carton 10, and for this purpose a packaging filler 16 in accordance with the invention is received within the open volume within the carton. Filler 16 broadly comprises an elongated, tubular body 17 having an elongated, transversely Z-shaped central reinforcing section 19 therein to rigidify the filler. Filler 16 more particularly includes a top wall 26, bottom wall 38, and spaced sidewalls 30 and 31. An elongated, central reinforcing sheet 35 is situated between walls 26 and 38 and has oppositely extending, marginal flaps 36 and 42 connected thereto and to the interior faces of adjacent sidewalls 30 and 31. It will be seen that the Z-shaped reinforcing section 19 is in effect an extension of bottom wall 38 in order to facilitate production of the filler.

Filler 16 is fabricated from a precut blank 18 of initially flat paper stock or the like (FIG. 4). Blank 18 comprises a generally rectangular paper sheet having a series of spaced, parallel crease and perforation lines along the length thereof. In particular, a first crease line 20 is provided adjacent the right-hand marginal edge thereof as viewed in FIG. 4 along with a die-cut tab portion 22 midway along the length of the latter which is important for purposes to be described hereinafter. The area between line 20 and the right-hand margin of blank 18 defines one sidewall 31 of the filler after fabrication thereof. A second fold line 24 is spaced from line 20 with the sheet area between lines 20 and 24 defining the top wall 26 of the filler.

Another crease line 28 is spaced from line 24 with the area between the line 24 and 28 presenting sidewall 30 of filler 16. In a similar manner, closely adjacent crease lines 32 and 34 are spaced from line 28, with flap 36 being defined between lines 32 and 34. In this connection, the planar sheet area between lines 28 and 32 defines the bottom wall 38 of the filler. Finally, a line of perforation 40 is provided adjacent the left-hand marginal edge of blank 18 to define flap 42, with the area between lines 34 and 40 serving as a central reinforcement sheet 35 for the completed filler 16.

Figure 5:
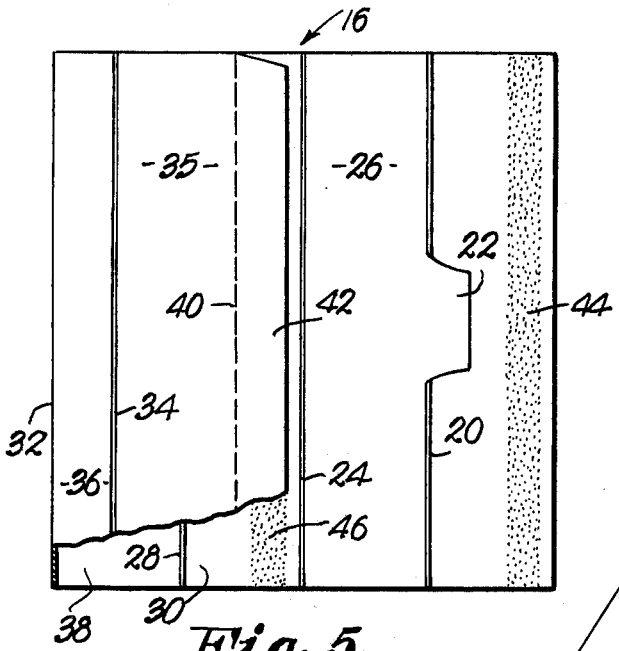
FIG. 5 is a side elevational view of the blank shown in FIG. 4 but illustrating the first production fold made during fabrication of the packaging filler.

A first glue line 44 is applied adjacent the righthand marginal edge of filler 18 with a second glue line 46 being provided proximal to crease line 24 along the surface of sidewall 30. As depicted in FIGS. 4 and 5, the glue lines 44 and 46 are applied to blank 18 along what will become the internal surface of completed filler 16.

Figure 6:
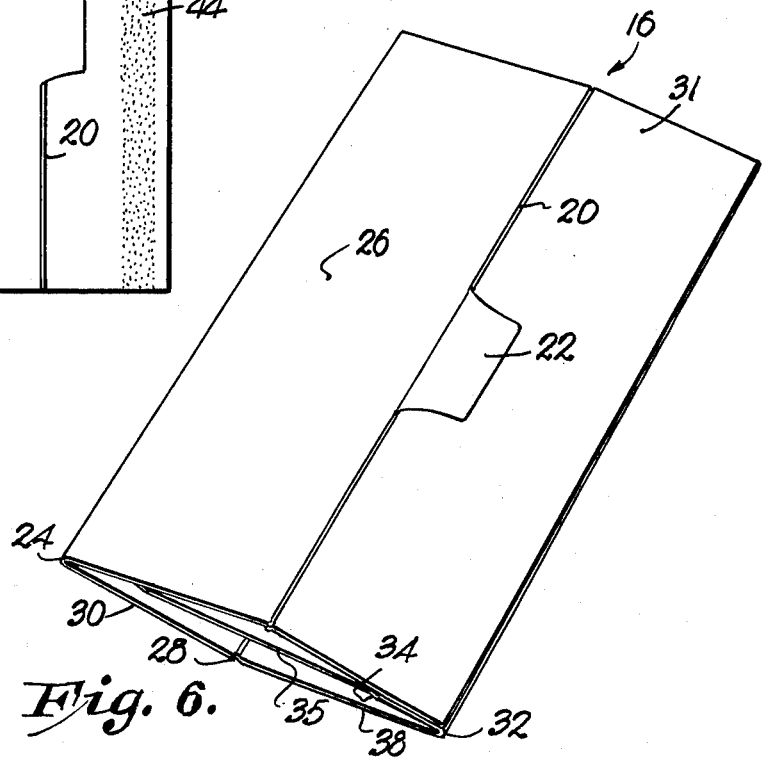
FIG. 6 is a perspective view of a completed packaging filler in its folded, generally flat storage position.

During production of filler 16 with automated folding apparatus, the following procedure is followed. First, after glue lines 44 and 46 have been applied, a first fold is taken along crease line 32 such that the leftmost section of blank 18 is folded back over the remainder of the blank. This has the effect of bonding flap 42 to sidewall 30, as best illustrated in FIG. 5. At this point, the right-hand section of the filler is folded along line 24 until glue line 44 contacts flap section 36 after the glue lines have hardened, a finished filler 16 is presented in its flattened storage position as best shown in FIG. 6.

In order to use filler 16 in a greeting card carton or the like it is only necessary to apply sideways pressure on the filler to shift the latter until it assumes a configuration which is substantially rectangular in cross section. At this point, tab portion 22 extends outwardly from top wall 26 and serves as a hold-down tab for greeting cards received within carton 10 (see FIG. 1).

Referring to FIGS. 2 and 3, it will be seen that flaps 36 and 42 extend in opposite directions with respect to central reinforcing sheet 35 defined between lines 34 and 40. Thus, the overall reinforcing section 19 within the confines of the generally tubular outer body 17 of the filler is essentially Z-shaped in cross section. It has been found that this configuration serves to unexpectedly enhance the strength characteristics of the overall filler and ensure that the latter is capable of withstanding normal shocks encountered in transit and during customer inspection. Moreover, utilization of a substantially Z-shaped central reinforcing section facilitates production of the overall filler by permitting mechanically folding of blank 18 without the necessity of any hand labor whatsoever. That is, if flap 42 were to extend in the same direction from sheet 35 as flap 36, it would be necessary to tuck-fold flap 42 during production of filler 16 and apply glue to the side thereof opposite from that shown in FIG. 4. As is well-known to those skilled in this art, such tuck-folds are extremely difficult if not impossible to achieve with mechanical folding machines and accordingly are to be avoided if at all possible. In fact, it has been found that production of a typical paper stock filler utilizing the Z-shaped central reinforcing section hereof is only approximately one-half as costly as a similar filler having a U-shaped central section requiring a tuck fold.

It will also be appreciated that creasing and die-cutting of paper stock to form a filler blank 18 is a simple matter in that only a single die-cutting operation is required. This is to be contrasted with other filler units of 2-piece construction for these requiring multiple die cuts. It will also be readily apparent that the fillers of the present inventon can be made in various sizes to conform to particular filler requirements. In addition the exposed top walls thereof can be printed with informational indicia relative to the display merchandise, if desired.

Another embodiment of the present invention is depicted in FIGS. 7–9. In this instance, a packaging filler **16*a* is provided which includes an elongated, tubular body 17*a* and a central, transversely Z-shaped central reinforcing section 19*a*. In addition, filler 16*a* includes a shiftable, hold-down flap 50 attached adjacent a longitudinal margin of the top wall 26*a*** of the filler and of greater width than the latter.

In particular, filler **16*a* is fabricated from an initially precut blank of paper stock and includes top wall 26*a*, bottom wall 38*a* and spaced sidewalls 30*a* and 31*a*. The central reinforcing section 19*a* includes a reinforcing sheet 35*a* having oppositely extending flaps 36*a* and 42*a* attached thereto and connected to the adjacent sidewalls of the filler. It will be noted that in this case flap 42*a* is interconnected between top wall 26a and reinforcing sheet 35*a* of the filler, such that the entire central reinforcing section 19*a* is in effect an extension of top wall 26*a*. This is in contrast to the embodiment of FIGS. 1–6** wherein the central section was an extension of the bottom wall of the filler.

Turning now to FIG. 7, the particular usefulness of the present embodiment of the present invention will be discussed. That is, filler **16*a* can be utilized in the normal manner in a carton 10*a* packed with a stack of cards 12*a* and envelopes 14*a*. In some cases, however, it may be desireable to display the cards along with inside of the envelopes themselves, and particularly the inside of the flaps 52 thereof. As can be appreciated, if decorated or foil-lined envelopes are provided, it is advantageous to display this feature to potential customers. In this connection, an envelope 54 is placed within the topmost card 56 in the stack thereof with the flap 52 of the envelope extending outwardly therefrom. This envelope flap is in covering relationship to the top wall 26*a* of filler 16*a*, thus precluding the use of advertising or other informational indicia on this top wall. In order to provide the necessary sale information and a holddown for envelope flap 52, filler 16a is provided with the upper flap 50 described above. As shown in FIG. 7, flap 50 covers a portion of the envelope flap 52** and provides an area for price and other necessary sale information while also ensuring that the envelope flap is displayed for customer inspection.

As in the prior embodiment, filler **16*a*** is fabricated from a single, continuous sheet of initially flat paper stock and can likewise be produced with economical, assembly line techniques as opposed to tedious and expensive manual labor. Accordingly, the advantages noted above in connection with the first embodiment of the invention also inhere in this form thereof.

Having thus described the invention, what I claim as new and desire to be secured by Letters Patent is:

1. In combination:

a merchandise container having a bottom wall and upstanding sidewalls for defining a merchandise-receiving space within the container;

a supply of merchandise positioned within said space and of lesser volume than the latter, one marginal edge of said merchandise and the adjacent, opposed sidewall of said container defining a filler-receiving space; and a filler of dimensions to substantially fill said filler-receiving space positioned within the latter, said filler including an elongated, hollow body having spaced, opposed, substantially parallel and planar sidewalls respectively adjacent said one marginal edge of the merchandise and said opposed container sidewall for preventing substantial shifting of said merchandise within the container; and an elongated, substantially planar reinforcing member of a length substantially equal to said sidewalls and positioned within said body in substantially spanning and perpendicular relationship to the body sidewalls, said member including respective, unitary marginal flaps connected to opposed sides of the member, each of said flaps extending substantially the entire length of the member and adjacent body sidewall and being connected to the latter.

said marginal flaps extending in opposite directions relative to said reinforcing member for rigidifying said filler.

2. The combination of claim 1 wherein said merchandise comprises a stack of greeting cards.

3. The combination of claim 1 including a hold-down tab extending from the upper margin of said filler and in overlying relationship to a portion of the upper margin of said merchandise.

4. The combination of claim 1 wherein said body, reinforcing member and flaps are formed from a single, continuous piece of paper stock.

5. The combination of claim 1 including a separate flap secured adjacent one longitudinal upper edge of said body and of greater width than the distance between said body sidewalls.

* * * * *